United States Patent [19]
Marshall et al.
[11] 4,317,652
[45] Mar. 2, 1982

[54] MARKSMANSHIP TRAINING DEVICE FOR SIMULATING LONG RANGE WEAPONS

[75] Inventors: Albert H. Marshall; Gary M. Bond, both of Orlando; Bon F. Shaw, Winter Park, all of Fla.

[73] Assignee: The United States of America as represented by the Secretary of the Navy, Washington, D.C.

[21] Appl. No.: 199,406

[22] Filed: Oct. 22, 1980

[51] Int. Cl.[3] ..... F41G 3/26
[52] U.S. Cl. ..... 434/22
[58] Field of Search ..... 434/22; 273/310, 312, 273/316, 371, 381

[56] References Cited

U.S. PATENT DOCUMENTS

| | | | |
|---|---|---|---|
| 3,657,826 | 4/1972 | Marshall et al. | 434/22 |
| 3,813,795 | 6/1974 | Marshall et al. | 434/22 |
| 3,927,480 | 12/1975 | Robertsson | 434/22 |
| 3,995,376 | 12/1976 | Kimble et al. | 434/22 |
| 4,164,081 | 8/1979 | Berke | 434/22 |
| 4,177,580 | 12/1979 | Marshall et al. | 434/22 |
| 4,195,422 | 4/1980 | Budmiger | 434/22 X |
| 4,281,993 | 8/1981 | Shaw | 434/22 |

*Primary Examiner*—William H. Grieb
*Attorney, Agent, or Firm*—Robert F. Beers; Robert W. Adams; David S. Kalmbaugh

[57] ABSTRACT

A marksmanship training device is disclosed for simulating long range weapons so as to train a marksman in the use of the particular weapon being simulated. The marksmanship training device comprises a laser transmitter mounted within the weapon being simulated which, when activated by the marksman, broadcasts at a target a square wave beam of laser light having a predetermined frequency. A receiver, mounted upon the target, will sense only a square wave laser light beam having the predetermined frequency mentioned above and activate a buzzer so as to indicate that the marksman has scored a hit upon the target.

21 Claims, 4 Drawing Figures

MARKSMANSHIP TRAINING DEVICE FOR SIMULATING LONG RANGE WEAPONS

BACKGROUND OF THE INVENTION

1. Field of the Invention

This invention relates generally to weapons training simulators. In particular, this invention relates to a weapons training simulator which utilizes a laser transmitter at the firing point, and a receiver at the aiming point so as to provide an efficient hit indication of the target aimed at by a trainee marksman.

2. Description of the Prior Art

In training military and other personnel in the use of long range weapons, rifles, and the like, the military, as well as civilian agencies concerned with such training, have utilized laser emissions instead of live ammunition at the firing point, and a form of detector apparatus at the target or aiming point combined with some audible or visible indication that a hit has been scored upon the target.

One such device of the prior art utilizes an array of solar cells combined with transformers, detectors, and other electronic amplifying equipment affixed directly to the target such that when the target is impinged by a laser beam from the firing point, at least one of the detectors will detect its presence, and generate an alarm through the solar cell pick-up and electronic amplifying equipment to activate a hit indicator.

Still another device of the prior art utilizes a target having mounted on the front portion thereof a reflective surface which reflects therefrom an incoming laser beam all the way back to the firing point where a detector is located. The detector, in turn, picks up the retroreflected laser beam and then provides an audible and/or visible indication that a hit has been scored upon the target.

While satisfactory for their intended purpose of marksmanship training, the aforementioned devices of the prior art ordinarily leave something to be desired, especially from the standpoints of aiming accuracy at long distances, safety, and complexity in design. In addition, the aforementioned devices of the prior art are designed for use at limited distances.

SUMMARY OF THE INVENTION

The subject invention overcomes some of the disadvantages of the prior art, including those mentioned above, in that it comprises a relatively simple long range weapons fire simulation system which is responsive to laser light pulses from a laser transmitter rather than being responsive to ordinary light or other less coherent, concentrated, and intense types of radiant energy. Consequently, it is far more sensitive which, in turn, makes it far more efficient and accurate in its response, in that it more closely simulates the aiming accuracy of a long range weapons system.

Included in the subject invention is the aforementioned laser transmitter which broadcasts therefrom a square wave beam of laser light, and a receiver mounted upon a target adapted for detecting the aforementioned square wave beam of laser light, and for providing in response to the detection of the square wave beam of laser light thereby, a hit indicator signal.

The transmitter comprises timing circuit means for providing a fundamental clock signal having a predetermined frequency and switching circuit means for activating a laser light source in response to the aforementioned fundamental clock signal. The laser light source, in turn, emits therefrom the aforementioned square wave beam of laser light, the frequency of which is the same as the frequency of the aforementioned fundamental clock signal.

The receiver comprises a sensor element adapted to detecting the square wave beam of laser light and for providing, in response to the detection of the square wave beam of laser light, a square wave signal having a frequency the same as the frequency of the square wave beam of laser light, a variable gain amplifier for amplifying the square wave signal, and a phase lock loop circuit for producing in response to the square wave signal the aforementioned hit indicator signal. The hit indicator signal, in turn, activates a buzzer so as to indicate that a hit has been scored upon the target.

DESCRIPTION OF THE PREFERRED EMBODIMENT

Figure 1:
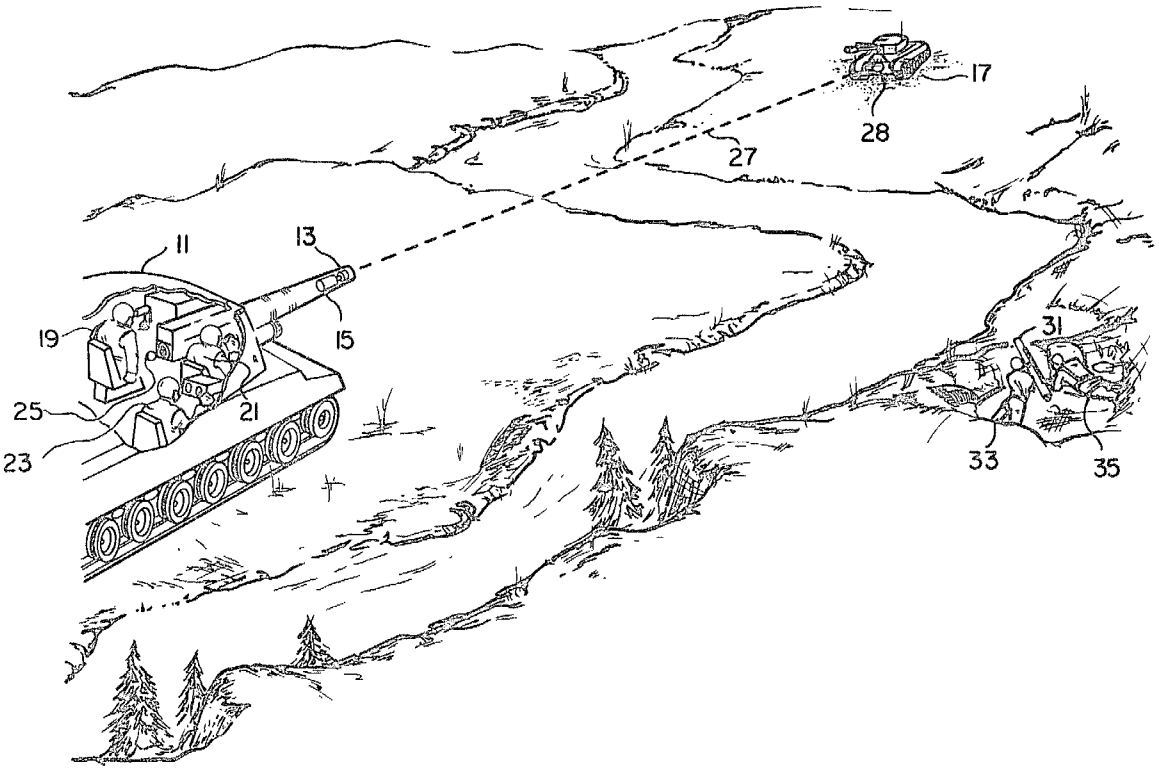
FIG. 1 is a pictorial representation of a typical situation in which the subject invention may be utilized to an advantage.

The preferred embodiment of the subject invention will now be discussed in some detail in conjunction with all of the figures of the drawing, wherein like parts are designated by like reference numerals, insofar as it is possible and practical to do so.

Referring now to FIG. 1, there is shown a tank 11 having a barrel 13 in which is mounted a laser transmitter 15. As tank 11 is aimed for direct fire maneuvers at a tank 17, barrel 13 of tank 11 is moved in azimuth and elevation by trainees 19, 21, and 23. Tank 11 is fired in simulation by trainee 19 activating a three position selector switch 25, which is the trigger mechanism of the subject invention and which, when activated by trainee 19, energizes laser transmitter 15 such that laser transmitter 15 will broadcast along a predetermined optical or light path a square wave beam of laser light 27.

Mounted upon tank 17 is a receiver 28 which will detect the square wave beam of laser light 27 broadcast by laser transmitter 15. Whenever receiver 28 detects the square wave beam of laser light 27 broadcast by laser transmitter 15, receiver 28 will activate a buzzer 29, FIG. 2, located in tank 17. This, in turn, indicates to an instructor, not shown, seated in tank 17 that trainees 19, 21, and 23 have scored a hit upon tank 17.

At this time, it may be noted that a variety of weapons such as a bazooka 31 may be utilized with the subject invention by mounting laser transmitter 15 therein. This, in turn, allows trainees 33 and 35 to aim and fire bazooka 31 in simulation at tank 17.

Figure 2:
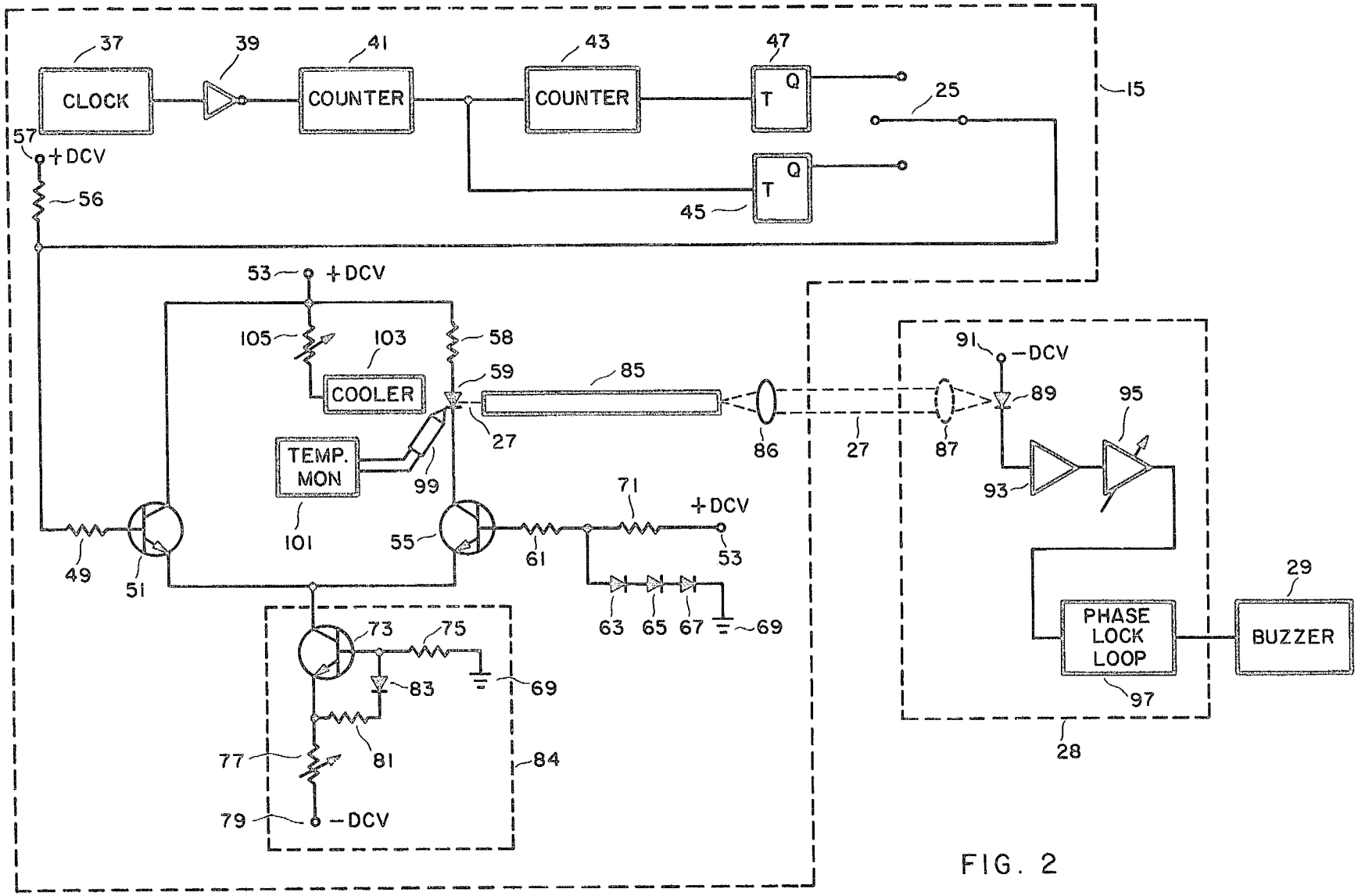
FIG. 2 is an electrical schematic diagram of the system constituting the subject invention.

Referring now to FIG. 2, there is shown a schematic diagram of laser transmitter 15 comprising a master clock 37, the output of which is connected to the input of an inverter 39, with the output thereof connected to the input of a counter 41. The output of counter 41 is, in turn, connected to the input of a counter 43 and the trigger input of a flip-flop 45.

The output of counter 43 is connected to the trigger input of a flip-flop 47, the Q output of which is connected to the first input of three position selector switch 25. In addition, the Q output of flip-flop 45 is connected to the second input of selector switch 25, with the third or neutral input thereof being left unconnected.

The output of selector switch 25 is connected through a resistor 49 to the base of an NPN transistor 51, the collector of which is connected to the output of a positive direct current voltage source 53, and the emitter of which is connected to the emitter of an NPN transistor 55. In addition, the base of NPN transistor 51 is connected through resistor 49 and a resistor 56 to the output of a positive direct current voltage source 57.

The output of positive direct current voltage source 53 is connected through a resistor 58 to the input of a laser light source 59 which emits therefrom, when activated, the aforementioned square wave beam of laser light 27. The output of laser light source 59 is, in turn, connected to the collector of NPN transistor 55, the base of which is connected through a resistor 61 to the input of a diode 63. The output of diode 63 is connected to the input of a diode 65, the output of which is connected to the input of a diode 67, with the output thereof connected to a ground 69. In addition, the base of NPN transistor 55 is connected through resistor 61 and a resistor 71 to the output of positive direct current voltage source 53.

The emitters of NPN transistors 51 and 55 are connected to the collector of an NPN transistor 73, the base of which is connected through a resistor 75 to ground 69. The emitter of NPN transistor 73 is connected through a variable resistor 77 to the output of a negative direct current voltage source 79. In addition, the emitter of NPN transistor 73 is connected through a resistor 81 to the output of a diode 83, the input of which is connected to the base of NPN transistor 73.

It should be noted that the combination of NPN transistor 73, resistors 75 and 81, diode 83, variable resistor 77, and negative direct current voltage source 79, when combined in the manner described above, form a constant current source 84, the operation of which will be described more fully below.

Spatially disposed downstream from laser light source 59 along optical light path 27 is a fiber optics bundle 85 which, along with laser light source 59, is commercially available from RCA of Lancaster, Pa., with the model number being C86010E.

Spatially disposed downstream from fiber optics bundle 85 along optical light path 27 is a lens 86. Lens 86 is positioned such that the focal point thereof is located at the end of fiber optics bundle 85.

Spatially disposed downstream from lens 86 along optical light path 27 is receiver 28 which includes a lens 87 positioned downstream from lens 86. Spatially disposed downstream from lens 87 is a photodiode sensor 89 which is positioned at the focal point of lens 87.

The output of a negative direct current voltage source 91 is connected to the input of photodiode sensor 89, the output of which is connected to the input of an amplifier 93, with the output thereof connected to the input of a variable gain amplifier 95. The output of variable gain amplifier 95 is, in turn, connected to the input of a phase lock loop circuit 97, the output of which is connected to the aforementioned buzzer 29.

At this time it may be noteworthy to mention that the series combination of photodiode sensor 89 and amplifier 93 may be, for example, a hybrid receiver, Model MDA 7705, manufactured by Meret, Inc., of Santa Monica, Calif. In addition, it may be noted that phase lock loop circuit 97 may be a frequency selective phase lock loop assembly, Model RE 8001, manufactured by Meret, Inc.

Affixed to laser light source 59 is a temperature probe 99, the first terminal of which is connected to the first terminal of a temperature monitor 101 and the second terminal of which is connected to the second terminal of temperature monitor 101. Positioned adjacent laser light source 59 is a cooler element 103, the output of which is connected through a variable resistor 105 to the output of direct current voltage source 53.

It may be noted at this time that cooler element 103 may be a thermo-electric module, Model 930-71, manufactured by Borg-Warner, Inc., of Des Plaines, Ill. In addition, temperature monitor 101 may be an Omega-temp Temperature Monitor manufactured by Omega Engineering, Inc., of Stamford, Conn.

The operation of the subject invention will now be discussed briefly in conjunction with all of the figures of the drawing.

Referring first to FIG. 1, there is shown tank 11, the barrel 13 of which is being aimed in azimuth and elevation by trainees 19, 21, and 23 for direct fire maneuvers at tank 17. Tank 11 is then fired in simulation by trainee 19 activating three position selector switch 25 which, when activated by trainee 19, energizes laser transmitter 15 such that laser transmitter 15 will broadcast square wave light beam 27 at tank 17. Whenever receiver 28 detects the square wave beam of laser light 27 broadcast by laser transmitter 15, receiver 28 will activate buzzer 29, FIG. 2. This, in turn, indicates to the aforementioned instructor, not shown, seated in tank 17 that trainees 19, 21, and 23 have scored a hit upon tank 17.

As mentioned above, a variety of weapons, such as bazooka 31, may be utilized with the subject invention by mounting laser transmitter 15 therein. Because the subject invention operates in the same manner when laser transmitter 15 is mounted in barrel 13 of tank 11 as when laser transmitter 15 is mounted in bazooka 31, and for the sake of keeping this disclosure as simple as possible, only the operation of the subject invention with respect to tank 11 will be described.

Figure 3:
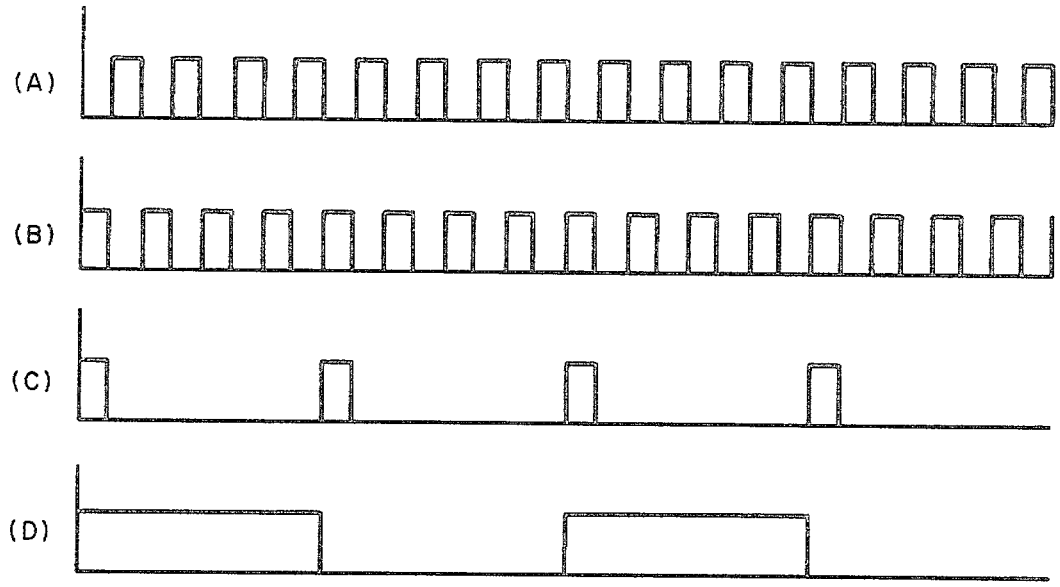
FIG. 3 is an ideal graphical representation of some of the signals produced at the outputs of some of the electrical components of FIG. 2.

Referring now to FIG. 2, there is shown clock 37 which generates a master clock signal having a preset frequency of 786 kilohertz similar to that depicted in FIG. 3(A). The clock signal of FIG. 3(A) is supplied to the input of inverter 39 which inverts the aforementioned clock signal so as to provide at the output thereof a clock signal similar to that illustrated in FIG. 3(B). The clock signal of FIG. 3(B) is then supplied to the input of counter 41 which divides the frequency thereof by four so as to provide at the output thereof a clock signal similar to that depicted in FIG. 3(C).

The clock signal of FIG. 3(C) is supplied to the trigger input of flip-flop 45, which divides the frequency thereof by two so as to provide at the Q output thereof a clock signal similar to that illustrated in FIG. 3(D), the frequency of which is 98.25 kilohertz.

Figure 4:
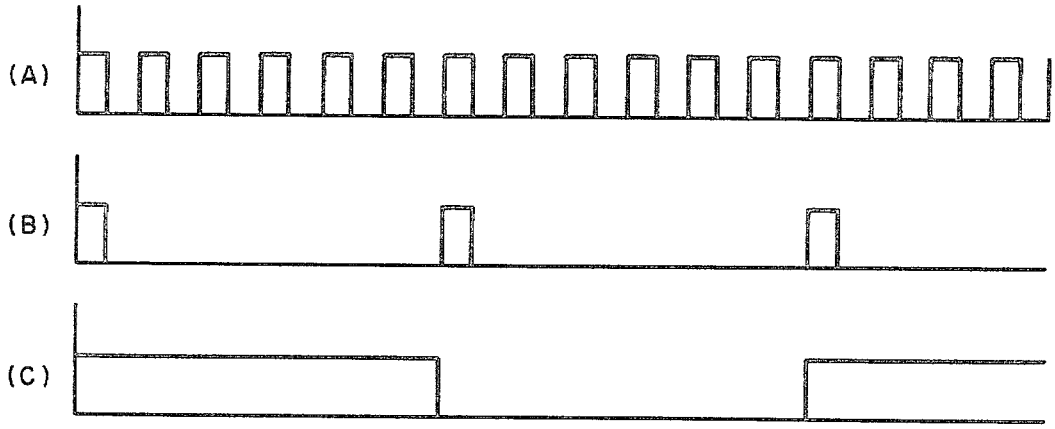
FIG. 4 is an expanded graphical representation of one of the signals of FIG. 3 and other internal component output signals of the system of FIG. 2 coordinated therewith.

To facilitate the better understanding of that portion of the mode of operation of the invention to be discussed now, it would appear to be noteworthy to mention at this time that the signal waveform of FIG. 4(A) is, in fact, identical to that of FIG. 3(C). However, in the portrayal of the signal waveform of FIG. 4(A), the time frame represented by the abscissa has been greatly reduced so as to provide a frame that will permit the disclosure of the other signals shown in FIG. 4(B) and FIG. 4(C).

The signal of FIG. 4(A) which emanates from the output of counter 41 is supplied to the input of counter 43, which divides the frequency thereof by six so as to provide at the Q output thereof a clock signal similar to that illustrated in FIG. 4(B). The clock signal of FIG. 4(B) is then supplied to the trigger input of flip-flop 47, which divides the frequency thereof by two so as to provide at the Q output thereof a clock signal similar to that illustrated in FIG. 4(C), the frequency of which is 16.375 kilohertz.

At this time it may be noteworthy to mention that the clock signal of FIG. 4(C) is to be utilized by the subject invention since receiver 28 is adapted to detect a square wave beam of laser light having a frequency of 16.375 kilohertz, as will be explained more fully below. In addition, it may be noted at this time that the clock signal of FIG. 3(D) is adapted for utilization with a receiver element described in U.S. patent application Ser. No. 199,156, entitled Weapons Training Apparatus for Simulating Long Range Weapons, by Albert H. Marshall, Gary M. Bond, and Bon F. Shaw, filed concurrently with this application.

The clock signal of FIG. 4(C) which emanates from the Q output of flip-flop 47 passes through selector switch 25 and resistor 49 to the base of transistor 51 so as to activate transistor 51. Whenever the base of transistor 51 is in the logic "1" state, or in response to each clock pulse of the clock signal of FIG. 4(C), the direct current voltage signal provided by positive direct current voltage source 53 will pass through transistors 51 and 73, and variable resistor 77 to the output of negative direct current voltage source 79. This, in turn, inactivates transistor 55, which is now reverse biased at the base to emitter junction thereof, thereby inactivating laser light source 59 so as to prevent laser light source 59 from broadcasting square wave laser light beam 27, as will be discussed more fully below.

Whenever the clock signal of FIG. 4(C) is in the logic "0" state, transistor 51 is inactivated, thereby activating transistor 55 which is now forward biased at the base to emitter junction thereof, as will be discussed more fully below. This, in turn, allows the direct current voltage signal provided by direct current voltage source 53 to pass through resistor 58, light source 59, and transistor 55 so as to activate light source 59. Light source 59, in response to the direct current voltage signal provided by direct current voltage source 53, provides a stream of laser light. Thus, in response to the clock signal of FIG. 4(C), laser light source 59 will broadcast along the above mentioned predetermined optical light path, square wave beam of laser light 27.

At this time it should be noted that the series combination of resistor 71 and diodes 63, 65, and 67 form a voltage divider circuit such that the base of transistor 55 is biased at a constant voltage. This, in turn, assures that the base to emitter junction of transistor 55 is forward biased whenever transistor 51 is inactivated by the clock signal of FIG. 4(C).

Whenever selector switch 25 is in the neutral position, so as to prevent the clock signal of either FIG. 3(D) or FIG. 4(C) from passing therethrough, the direct current voltage signal provided by direct current voltage source 57 will pass through resistors 56 and 49 to the base of transistor 51 such that the base of transistor 51 will be in the logic "1" state. This, in turn, as discussed previously, activates transistor 51 such that the direct current voltage signal provided by direct current voltage source 53 will pass therethrough so as to inactivate laser light source 59, thereby preventing laser light source 59 from broadcasting square wave beam of laser light 27.

At this time it may be noteworthy to mention that the direct current voltage signal provided by direct current voltage source 53 is maintained at a constant current level of approximately two hundred milliamps by constant current source 84 so as to maintain the power output of square wave laser light beam 27 at a constant power level of two milliwatts. A negative direct current voltage signal provided by direct current voltage source 79 flows from ground 69, through resistor 75, diode 83, resistor 81, and variable resistor 77, to direct current voltage source 79, such that the voltage drop from the base of transistor 73 to the emitter thereof remains at a constant value. This, in turn, will cause the direct current voltage signal provided by direct current voltage source 53 to remain at the aforementioned current level of approximately two hundred milliamps.

In addition, it should be noted that an increase in the resistance of variable resistor 77 will decrease the current level of the direct current voltage signal provided by direct current voltage source 53, while a decrease in the resistance of variable resistor 77 will increase the current level of the aforementioned direct current voltage signal. This, in turn, allows for the variation of the output power level of square wave laser light beam 27 broadcast by laser light source 59.

Also, it may be noteworthy to mention that diode 83 is utilized within the subject invention to compensate for temperature variations within transistor 73 such that when transistor 73 is active, the direct current passing therethrough will remain constant.

Further, it should be noted that temperature probe 99 continuously monitors the temperature of laser light source 59. Temperature probe 99 then supplies to temperature monitor 101 an analog signal proportional to the temperature of laser light source 59 monitored thereby. Temperature monitor 101, in response to the aforementioned analog signal, will provide trainees 19, 21, and 23, FIG. 1, with a visual indication of the temperature of laser light source 59 so as to allow one of the aforementioned trainees to adjust variable resistor 105, thereby either increasing or decreasing the cooling capacity of cooler element 103. This, in turn, insures that the temperature of laser light source 59 will remain at a constant value so as to make certain that the output power level of square wave laser light beam 27 broadcast by laser light source 59 will remain at the aforementioned value of two milliwatts.

Referring now to FIGS. 1 and 2, whenever tank 11 is fired in simulation by trainee 19 activating three position selector switch 25, light source 59 broadcasts through fiber optics bundle 85, square wave laser light beam 27. Fiber optics bundle 85, in turn, integrates square wave laser light beam 27 such that the square wave laser light beam 27 which appears at lens 86 is circular in shape, thus simulating a live round. Lens 86 collimates square wave laser light beam 27, which is then transmitted along the above mentioned optical light path to lens 87 of receiver 28.

Lens 87 focuses square wave laser light beam 27 upon photodiode sensor 89 which, when activated by the negative direct current voltage signal provided by negative direct current voltage source 91, will detect square wave laser light beam 27 broadcast by laser light source 59. Photodiode sensor 89 will then provide at the output thereof, in response to the square wave laser light beam 27 sensed thereby, a square wave signal, the frequency of which is 16.375 kilohertz. The square wave signal provided by sensor 89 is supplied through amplifiers 93 and 95, which amplify the aforementioned signal to a more useful voltage level, to the input of phase lock loop circuit 97.

Phase lock loop circuit 97 is preset to provide at the output thereof a hit indicator signal, which is a direct current voltage signal, upon receiving at the input thereof a square wave signal having a frequency of 16.375 kilohertz. Thus, whenever the square wave signal provided by sensor 89 is received at the input of phase lock loop circuit 97, phase lock loop circuit 97 will supply to the input of buzzer 29 the aforementioned hit indicator signal. This, in turn, activates buzzer 29 so as to indicate to the instructor seated within tank 17 that tank 11 has scored a hit thereon.

From the foregoing, it may readily be seen that the subject invention comprises a new, unique, and exceedingly useful marksmanship training device for simulating long range weapons which constitutes a considerable improvement over the known prior art. Obviously, many modifications and variations of the present invention are possible in light of the above teachings. It is, therefore, to be understood that within the scope of the appended claims the invention may be practiced otherwise than as specifically described.

What is claimed is:

1. A marksmanship training device comprising, in combination:

an imitation weapon having a barrel, and a trigger mechanism for effecting the simulated firing thereof, said trigger mechanism having an input and an output;

timing circuit means having an output connected to the input of the trigger mechanism of said weapon for generating a fundamental clock signal, said fundamental clock signal having a predetermined frequency;

emitter means mounted within the barrel of said weapon, and having an input and an output for broadcasting along a predetermined optical path, in response to said fundamental clock signal, a collimated square wave beam of laser light, said collimated square wave beam of laser light having a frequency the same as the frequency of said fundamental clock signal;

switching circuit means having a first input connected to the output of said trigger mechanism, a second input connected to the output of said emitter means, and an output connected to the input of said emitter means for activating said emitter means such that said emitter means will broadcast therefrom said collimated square wave beam of laser light whenever a marksman triggers the trigger mechanism of said weapon;

sensing means spatially disposed downstream from said emitter means, mounted upon a target, and having an output adapted for detecting the collimated square wave beam of laser light broadcast along said predetermined optical path, and for producing a square wave signal at the output thereof whenever the square wave beam of laser light broadcast along said predetermined optical path is detected thereby, said square wave signal having a frequency that is identical to that of said fundamental clock signal; and phase lock loop circuit means having an input connected to the output of said sensing means and an output for providing, in response to the square wave signal produced by said sensing means, a hit indicator signal.

2. The marksmanship training device of claim 1, wherein said weapon comprises a tank.

3. The marksmanship training device of claim 1, wherein said weapon comprises a bazooka.

4. The marksmanship training device of claim 1, wherein said trigger mechanism comprises a three position selector switch.

5. The marksmanship training device of claim 1, wherein said timing circuit means comprises:

a master clock having an output;

a first counter having an input connected to the output of said master clock, and an output;

a second counter having an input connected to the output of said first counter, and an output; and a flip-flop having a trigger input connected to the output of said second counter.

6. The marksmanship training device according to claim 1, wherein said switching circuit means comprises:

a first positive direct current voltage source having an output connected to the input of said emitter means;

a first transistor having a base, an emitter, and a collector, with the base thereof connected to the output of said trigger mechanism, and with the collector thereof connected to the output of said first positive direct current voltage source;

a first resistance having first and second terminals with the first terminal thereof connected to the output of said first positive direct current voltage source;

a ground;

a second resistance having first and second terminals, with the first terminal thereof connected to the second terminal of said first resistance, and with the second terminal thereof connected to said ground;

a second transistor having a base, an emitter, and a collector with the base thereof effectively connected to the second terminal of said first resistance and the first terminal of said second resistance, and with the collector thereof connected to the output of said emitter means;

a second positive direct current voltage source having an output connected to the base of said first transistor;

a negative direct current voltage source having an output; and a constant current circuit having first, second, and third terminals, with the first terminal thereof effectively connected to the emitters of said first and second transistors, with the second terminal thereof connected to said ground, and with the third terminal thereof connected to the output of said negative direct current voltage source.

7. The marksmanship training device according to claim 6, wherein said constant current source comprises:

an NPN transistor having a base, an emitter, and a collector, with the collector thereof effectively connected to the emitters of said first and second transistors;

a first fixed resistance having a first terminal connected to said ground, and a second terminal connected to the base of said NPN transistor;

a diode having an input connected to the base of said NPN transistor, and an output;

a second fixed resistance connected between the output of said diode and the emitter of said NPN transistor; and a variable resistance having a first terminal connected to the emitter of said NPN transistor, and a second terminal connected to the output of said negative direct current voltage source.

8. The marksmanship training device according to claim 1, wherein said emitter means comprises:

a laser light source having an input connected to the output of said switching circuit means, and an output connected to the second input of said switching circuit means;

a lens spatially disposed downstream from said laser light source along said predetermined optical path; and a fiber optics bundle positioned between said lens and said laser light source along said predetermined optical path.

9. The marksmanship training device according to claim 1, wherein said sensing means comprises:

a lens spatially disposed downstream from said emitter means;

a photodiode receiver spatially disposed downstream from said lens, and having an input and an output;

a negative direct current voltage source having an output connected to the input of said photodiode receiver; and an amplifier having an input connected to the output of said photodiode receiver.

10. The marksmanship training device of claim 1, further characterized by a variable gain amplifier connected between the output of said sensing means and the input of said phase lock loop circuit means.

11. The marksmanship training device of claim 1, further characterized by a buzzer having an input connected to the output of said phase lock loop circuit means, said buzzer adapted to indicate, in response to the hit indicator signal provided by said phase lock loop circuit means, that a hit has been scored upon said target by said marksman.

12. A weapons training system comprising, in combination:

a master clock having an output for generating a fundamental frequency master clock signal;

a first counter having an input connected to the output of said master clock and an output for generating a first clock signal having a frequency that is one fourth that of said master clock signal;

a second counter having an input connected to the output of said first counter and an output for generating a second clock signal having a frequency that is one sixth that of said first clock signal;

a flip-flop having a trigger input connected to the output of said second counter, and a Q output for generating a third clock signal having a frequency that is one half that of said second clock signal, said third clock signal having a series of uniformly spaced clock pulses;

a three position selector switch having first and second closed positions, a neutral position, first and second inputs, and an output, with the first input thereof connected to the Q output of said flip-flop for passing therethrough whenever said selector switch is in the first closed position, the third clock signal generated by said flip-flop;

a first positive direct current voltage source having an output for producing a first positive direct current voltage signal;

a first transistor having a base, an emitter, and a collector with the base thereof connected to the output of said selector switch and with the collector thereof connected to the output of said first positive direct current voltage source for passing therethrough, only in response to each clock pulse of said third clock signal, the first positive direct current voltage signal provided by said first positive direct current voltage source;

a laser light source having an input connected to the output of said first positive direct current voltage source and an output for broadcasting a square wave beam laser light along a predetermined optical path, said square wave beam of laser light having a frequency that is identical to that of said third clock signal;

a first resistance having first and second terminals, with the first terminal thereof connected to the output of said first positive direct current voltage source;

a ground;

a second resistance having first and second terminals with the first terminal thereof connected to the second terminal of said first resistance and with the second terminal thereof connected to said ground;

a second transistor having a base, an emitter, and a collector with the base thereof connected to the second terminal of said first resistance and the first terminal of said second resistance, and with the collector thereof connected to the output of said laser light source for effecting the activation of said laser light source, such that said laser light source will broadcast therefrom said square wave beam of laser light by passing therethrough the first positive direct current voltage signal provided by first positive direct current voltage source whenever said first transistor is rendered nonconductive by said third clock signal;

a second positive direct current voltage source having an output connected to the base of said first transistor for supplying to the base of said first transistor a second positive direct current voltage signal whenever said selector switch is in the neutral position so as to allow the first positive direct current voltage signal provided by said first positive direct current voltage source to pass through said first transistor, thereby inactivating said laser light source whenever said selector switch is in the neutral position;

a constant current circuit having first, second, and third terminals with the first terminal thereof effectively connected to the emitters of said first and second transistor, and with the second terminal thereof connected to said ground for maintaining the current flow of said first positive direct current voltage signal at a constant value so as to maintain the output power of the square wave beam of laser light broadcast by said laser light source at a predetermined level;

a first negative direct current voltage source having an output connected to the third terminal of said constant current source for providing a first negative direct current voltage signal so as to effect the activation of said constant current source;

a first lens spatially disposed downstream from said laser light source along said predetermined optical path for collimating the square wave beam of laser light broadcast by said laser light source;

a fiber optics bundle positioned between said laser light source and said first lens along said predetermined optical path;

a second lens spatially disposed downstream from said first lens adapted for receiving the square wave beam of laser light collimated by said first lens;

a photodiode sensor spatially disposed downstream from said second lens, and having an input and an output adapted for detecting the square wave beam of laser light broadcast along said predetermined optical path and for producing a square wave signal whenever the square wave beam of laser light broadcast along said predetermined optical path is detected thereby, said square wave signal having a frequency that is identical to that of said third clock signal;

a second negative direct current voltage source having an output connected to the input of said photodiode sensor for providing a second negative direct current voltage signal so as to effect the activation of said photodiode sensor;

a variable gain amplifier having an input connected to the output of said photodiode sensor and an output for amplifying the square wave signal produced by said photodiode sensor; and a phase lock loop circuit having an input connected to the output of said variable gain amplifier and an output for producing, in response to the square wave signal amplified by said variable gain amplifier, a hit indicator signal.

13. The weapons training system of claim 12, wherein said first and second transistors are NPN transistors.

14. The weapons training system of claim 12, wherein said second resistance comprises:

a first diode having an input connected to the second terminal of said first resistance, and an output;

a second diode having an input connected to the output of said first diode, and an output; and a third diode having an input connected to the output of said second diode.

15. The weapons training system of claim 12, wherein said constant current source comprises:

an NPN transistor having a collector effectively connected to the emitters of said first and second transistors, an emitter, and a base;

a first fixed resistance having a first terminal connected to said ground, and a second terminal connected to the base of said NPN transistor;

a diode having an input connected to the base of said NPN transistor, and an output;

a second fixed resistance connected between the output of said diode and the emitter of said NPN transistor; and a variable resistance having a first terminal connected to the emitter of said NPN transistor, and a second terminal connected to the output of said first negative direct current voltage source.

16. The weapons training system of claim 12, wherein said photodiode sensor comprises:

a photodiode receiver having an input connected to the output of said negative direct current voltage source and an output; and an amplifier having an input connected to the output of said photodiode receiver.

17. The device of claim 12, further characterized by an inverter connected between the output of said master clock and the input of said first counter.

18. The weapons training system of claim 12, further characterized by a flip-flop having a trigger input connected to the output of said first counter and a Q output connected to the second input of said selector switch.

19. The weapons training system of claim 12, further characterized by a buzzer having an input connected to the output of said phase lock loop circuit.

20. The weapons training system of claim 12, further characterized by:

a temperature probe affixed to said laser light source, said temperature probe having first and second terminals; and a temperature monitor having a first terminal connected to the first terminal of said temperature probe, and a second terminal connected to the second terminal of said temperature probe.

21. The weapons training system of claim 12, further characterized by:

a cooler element positioned adjacent said laser light source, said cooler element having an input; and a variable resistor connected between the output of said first positive direct current voltage source and the input of said cooler element.

* * * * *